US010240218B2

(12) United States Patent
Epps

(10) Patent No.: US 10,240,218 B2
(45) **Date of Patent: *Mar. 26, 2019**

(54) COAXIAL MATERIAL-STIRRING LANCE AND METHOD OF USE

(71) Applicant: Larry J Epps, Butler, PA (US)

(72) Inventor: Larry J Epps, Butler, PA (US)

( * ) Notice: Subject to any disclaimer, the term of this patent is extended or adjusted under 35 U.S.C. 154(b) by 179 days.

This patent is subject to a terminal disclaimer.

(21) Appl. No.: 15/183,020

(22) Filed: Jun. 15, 2016

(65) Prior Publication Data

US 2016/0369361 A1 Dec. 22, 2016

Related U.S. Application Data

(60) Provisional application No. 62/180,826, filed on Jun. 17, 2015.

(51) Int. Cl.

| | |
|---|---|
| ***C21C 7/00*** | (2006.01) |
| ***C21C 7/064*** | (2006.01) |
| ***C21C 7/072*** | (2006.01) |
| ***F27D 3/00*** | (2006.01) |
| ***F27D 3/16*** | (2006.01) |
| *C21C 5/46* | (2006.01) |

(52) U.S. Cl.

CPC ..... *C21C 7/0037* (2013.01); *C21C 7/0075* (2013.01); *C21C 7/064* (2013.01); *C21C 7/072* (2013.01); *F27D 3/0033* (2013.01); *F27D 3/16* (2013.01); *C21C 5/4613* (2013.01); *F27D 2003/169* (2013.01)

(58) Field of Classification Search

CPC ..... F27D 2003/168; F27D 2003/169

USPC ..... 266/225

See application file for complete search history.

(56) References Cited

U.S. PATENT DOCUMENTS

| | | | | |
|---|---|---|---|---|
| 3,901,445 | A | 8/1975 | Chang | |
| 4,550,898 | A | 11/1985 | Labate | |
| 4,588,170 | A | 5/1986 | Towns | |
| 5,015,291 | A | 5/1991 | Skach | |
| 5,308,043 | A | 5/1994 | Floyd | |
| 5,328,157 | A | 7/1994 | Mantey | |
| 5,336,293 | A | 8/1994 | Freissmuth | |
| 5,443,572 | A * | 8/1995 | Wilkinson | C21C 5/35 110/235 |
| 5,972,072 | A | 10/1999 | Kinsmen | |
| 6,322,610 | B1 | 11/2001 | Pavlicevic | |

(Continued)

FOREIGN PATENT DOCUMENTS

| | | |
|---|---|---|
| GB | 973521 | 10/1964 |

*Primary Examiner* — Scott R Kastler

(74) *Attorney, Agent, or Firm* — Karen Tang-Wai Sutton

(57) ABSTRACT

A coaxial material-stirring lance (40) and method used to treat molten metal in a ladle, the lance having a stirring gas chamber (48), and a plurality of gas permeable ports (50 52) arranged as upper and lower port arrays along a length of the gas chamber, and at least one material chamber (43) positioned inside and coaxial with the gas chamber and terminating in at least one material ports (60). In another embodiment, a second material chamber is included inside the gas chamber, parallel to and immediately adjacent the material chamber. In use, the coaxial material-stirring lance is lowered into the ladle of molten metal, and gas and material are both introduced into a respective chamber. Gas mixes material through the molten metal, causing impurities to be removed from the metal.

13 Claims, 10 Drawing Sheets

(56) References Cited

U.S. PATENT DOCUMENTS

| | | | | |
|---|---|---|---|---|
| 7,396,503 | B2 | 7/2008 | Cameron | |
| 7,563,405 | B2 | 7/2009 | Decastro | |
| 9,206,487 | B2 | 12/2015 | Hicks | |
| 9,259,780 | B2 | 2/2016 | Waitlevertch | |
| 2009/0229416 | A1 | 9/2009 | Cameron | |
| 2014/0298955 | A1 | 10/2014 | Okuyama et al. | |
| 2016/0053333 | A1 | 2/2016 | Hicks | |
| 2016/0369361 | A1* | 12/2016 | Epps | C21C 7/0037 |
| 2017/0362672 | A1* | 12/2017 | Epps | C21C 5/4606 |

* cited by examiner

SECTION A-A

SECTION B-B

SECTION C-C

SECTION D-D
UPPER

SECTION D-D
LOWER

SECTION A-A

SECTION B-B

SECTION C-C

SECTION A-A

SECTION B-B
LOWER

SECTION B-B
UPPER

SECTION C-C
UPPER

SECTION B-B
MIDDLE

SECTION C-C
MIDDLE

SECTION C-C
LOWER

SECTION D-D
UPPER

SECTION D-D
LOWER

SECTION A-A

SECTION B-B
LOWER

SECTION B-B
UPPER

SECTION C-C
UPPER

SECTION B-B
MIDDLE

SECTION C-C
MIDDLE

SECTION C-C
LOWER

SECTION D-D
UPPER

SECTION D-D
LOWER

COAXIAL MATERIAL-STIRRING LANCE AND METHOD OF USE

CROSS REFERENCE TO RELATED APPLICATIONS

Reference is made to and priority claimed from U.S. provisional application Ser. No. 62/180,826 filed 17 Jun. 2015

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION BY REFERENCE OF MATERIAL SUBMITTED ON A COMPACT DISC OR AS A TEXT FILE VIA THE EFS WEB SYSTEM

Not applicable.

STATEMENT REGARDING PRIOR DISCLOSURES BY THE INVENTOR OR A JOINT INVENTOR

Not applicable.

BACKGROUND OF THE INVENTION (1) Field of the Invention

The present invention pertains to the field of hot metal processing equipment and a method of using such equipment, for instance when making steel and iron.

(2) Background Art

The present invention relates to removal of impurities from a quantity of molten hot metal in a ladle during ironmaking, or alternatively, during steelmaking, as both processes use similar equipment and methods. References to steelmaking hence are also applicable to ironmaking and the use of the term "steelmaking" here is meant to include ironmaking as well. Slag is a term of art in the steelmaking industry referring to waste impurities produced when a desired metal has been separated from its raw ore, and typically floats to the surface of the molten metal. The impurities are skimmed off the surface of the molten or hot metal before the metal is sent for processing. Presence of impurities affects the quality and characteristics of the finished products, consolidating and efficiently removing impurities reduces production costs, and improves yield and metal quality.

Currently, steelmakers use two methods to separate waste or impurities from hot metal: (1) material methods that introduce desulfurizing agents deep into the hot metal to chemically bind the sulfur for easier removal, and (2) stirring methods that physically stir the hot metal by creating turbulence to agitate the body of metal so as to allow better distribution of desulfurizing agents and thus allow the desulfurizing agents to work more efficiently.

For material methods, material (desulfurizing agents) are commonly delivered into the hot metal via a typical "straight" through lance, one of many configurations of lances used in steelmaking, the lance consisting of a pipe with the majority of the length coated with a refractory material. The purpose of the refractory coating is to prevent the pipe from melting or distorting while submerged in the hot (molten) metal. This type of lance simply delivers the injected material to the bottom of the ladle with a minimum amount of stirring of the material into the hot metal. The only stirring gas available is provided by the gas which conveys the material into the ladle and/or the vaporization material.

A known issue with material methods using lances is the lack of uniform dispersion of material into the hot metal. The reagent is only present in sufficient quantities in around the lance itself, the result is a decreased effectiveness in removing sulfur impurities from the entire body of hot metal.

Regarding the material and stirring methods, the prior art teaches that use of the stirring method is optional when using a material injection method, although steelmakers often use the stirring method in conjunction with the material method as this typically results in better mixing of reagent and thus increased removal of impurities from the hot metal.

Another type of material lance design is a "T" lance, in which the bottom of the main pipe is shaped like an inverted letter "T" so as to move the material away from the lance in two different directions. This process is an improvement over the other lance style since it moves the material away from the lance and thus improves distribution of the material to a degree.

For stirring methods, a rotary lance has been developed to physically stir the hot metal, by rotating the lance while submerged in the hot metal via a motor and speed reducer system. The main drawback to this system is that it must be installed above a lance drive, which requires the lance drive to be of a substantial structure to be able to support the additional weight of the machinery needed to rotate the lance.

The prior art teaches the use of both material and stirring methods together, as well as separately, however in reality, most steelmakers are forced by economic reasons to use only one method as the capital investments required for both methods is often cost prohibitive. For instance, a highly effective material-stirring lance is described in U.S. Pat. No. 9,259,780 B2 (Waitlevertch et al.) granted 16 Feb. 2016, for which the present inventor is also a co-inventor, but the main drawback of this system is the need for costly modifications to existing equipment in order to support the weight of the machinery required to rotate the lance, again adding to capital costs, and downtime to do such modifications.

What is needed is an improved lance that increases efficiency and requires no significant nor expensive investments or modification to existing equipment, and is cost effective to steelmakers.

BRIEF SUMMARY OF THE INVENTION

Accordingly, in a first aspect of the invention, the apparatus is a coaxial material-stirring lance for use in steelmaking, having a gas chamber for receiving and distributing stirring gas, with at least one port formed along a body of the chamber, and at least one material chamber for receiving and distributing reagents ("material"), with at least one discharge port formed at a terminal end of the material chamber, wherein the material chamber is positioned inside the gas chamber so as to be coaxial with the gas chamber, and an exterior of the gas chamber is covered in a refractory coating to protect the lance from heat damage.

In yet a second aspect of the invention, the material chamber of the coaxial material-stirring lance terminates in a pair of material discharge ports arranged in a T-shaped orientation.

In still a third aspect of the invention, the gas chamber has an array of stirring ports through which the gas in the chamber is emitted, in a first embodiment arranged as an alternating pattern of x and cross-shaped port arrays, in a second embodiment as an alternating pattern of pairs of opposed ports, and in a third embodiment as a spiral array of ports.

In a fourth aspect of the invention, a second material chamber adjacent and parallel to the material chamber and housed inside the gas chamber is provided.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1:
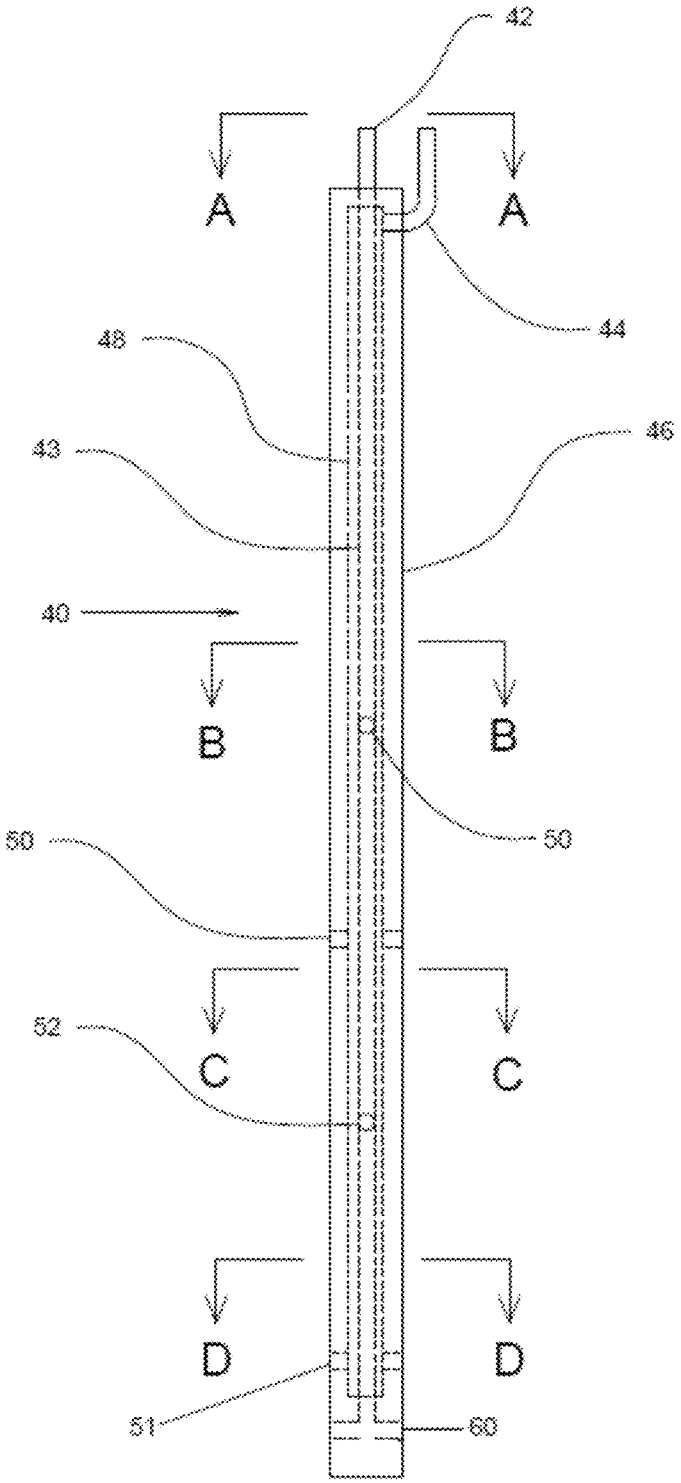
FIG. 1 is a side elevation, cross sectional view of a coaxial material-stirring lance according to the invention, where a single material chamber is housed inside a gas chamber.

The following is a list of reference labels used in the drawings to label components of different embodiments of the invention, and the names of the indicated components.

2 ladle
4 slag pot
5 desulfurization reagent or material
6 hot metal
6*a* surface of hot metal
8 ladle spout
10 gas bubbles
24 slag
40 coaxial material-stirring lance
42 material connection pipe
43 material chamber
44 gas connection pipe
46 refractory coating
48 stirring gas chamber or gas chamber
50 upper stirring port or upper port
51 bottom stirring port or bottom port
52 lower stirring port or lower port
54 first port array embodiment or cross-shaped port array
56 second port array embodiment or opposed port array
58 third port array embodiment or spiral port array
60 material discharge port

GLOSSARY OF IMPORTANT TERMS

Hot metal or molten metal: metal heated to a temperature such that the metal is in a liquid state, and includes metals commonly purified by heating in a ladle such as steel and iron Material: desulfurization reagent or reagents Port: a structure capable of passing gas, including but not limited to porous plugs, pipes, and nozzles

DETAILED DESCRIPTION

A coaxial material-stirring lance 40 and method of use is shown in FIGS. 1-5.

Turning now to FIG. 1, the coaxial material-stirring lance 40 is shown in a side elevation, cross sectional view comprising a pair coaxial chambers, an outer chamber being a stirring gas or gas chamber 48 having a gas connection pipe 44 at an uppermost end, a body having a length formed with at least one upper stirring port or upper port 50 leading from the gas chamber 48 to an exterior of the gas chamber, and terminating in a bottom stirring port or bottom port 51 near or at a lowermost end of the gas chamber, with a lower stirring port or lower port 52 positioned between the upper port and the bottom port, and a material chamber 43, located inside the gas chamber, having a material connection pipe 42 at an uppermost end and terminating in at least one material discharge port 60 at a lowermost end of the material chamber 43. A lance refractory coating 46 covers and encases the exterior of the gas chamber to protect it from damage caused by submerging the coaxial material-stirring lance 40 into a quantity of hot metal 6 in a ladle 2, the ports 50 51 52 allowing gas present in the gas chamber 48 to exit the coaxial material-stirring lance 40.

Figure 1A:
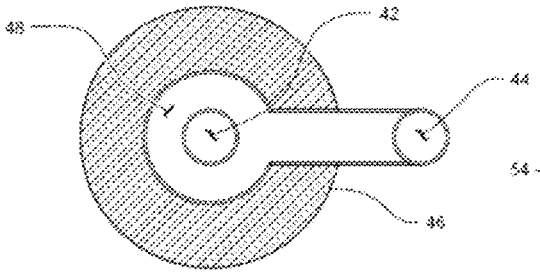
FIG. 1*a* is a top cross sectional view of the coaxial material-stirring lance in FIG. 1 taken at section A-A.
Figure 1B:
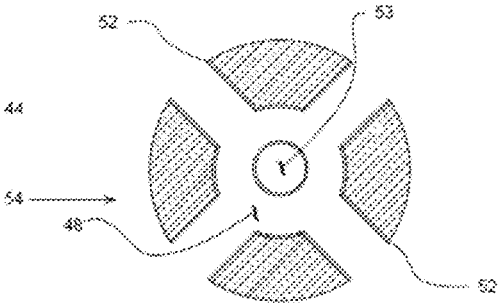
FIGS. 1*b-c* are top cross sectional views of a first port array embodiment of the coaxial material-stirring lance shown in FIG. 1, taken at sections B-B and C-C, the first port array embodiment arranged in a repeating pattern of alternating X and cross-shaped port arrays.
Figure 1C:
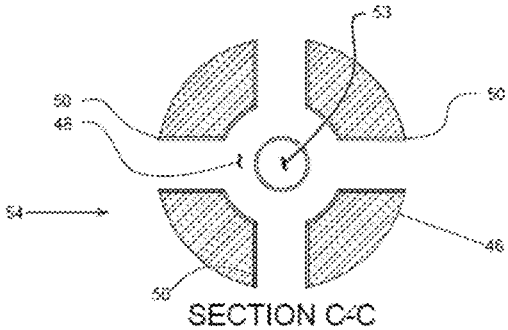
Figure 1D:
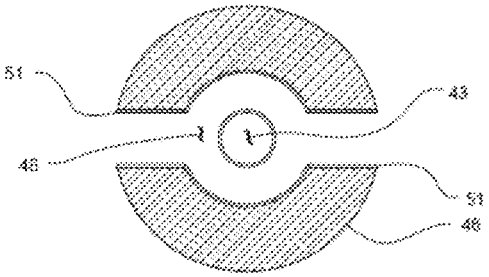
FIGS. 1*d* and 1*h* are top cross sectional views of the first port array embodiment and a second port array embodiment of the coaxial material-stirring lance in FIG. 1, taken at upper and lower sections D-D, respectively.

Turning now to FIGS. 1*a-d*, in a first port array embodiment or cross-shaped port array 54, taken along a horizontal cross section A-A shown in FIG. 1*a*, the stirring gas connection pipe 44 is shown leading into the gas chamber 48, the exterior surface of the gas chamber 48 encased with the refractory coating 46. The materials connection pipe 42 is positioned inside the stirring gas chamber 48. At a horizontal cross sections B-B and C-C, shown in FIGS. 1*b-c*, respectively, the gas chamber 48 is provided with an upper array having four upper ports 50, shown in FIG. 1*b* as two pairs of opposed ports arranged in 90 degree and 180 degree or cross-shaped configuration, the upper ports 50 forming four open channels leading out of the gas chamber 48 and through the refractory coating 46, and in FIG. 1*c*, as a same two pairs of opposed ports as in FIG. 1*b*, except the lower ports 52 shown in cross section C-C, relative to the upper array of ports in FIG. 1*b* are turned such that a lower array of ports 52 are at an approximate 45 degree alignment with the upper array of ports, resembling an X-shape creating an alternating cross and x port array pattern.

Figure 1H:
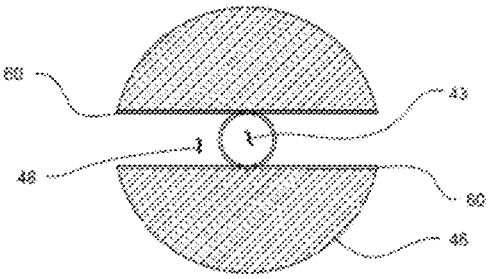
Figure 1E:
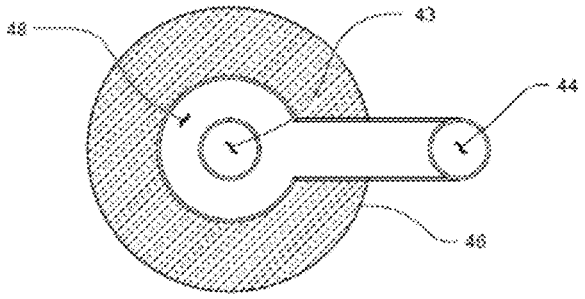
FIG. 1*e* is a top cross sectional views of the second port array embodiment of the coaxial material-stirring lance shown in FIG. 1, taken at section A-A.
Figure 1F:
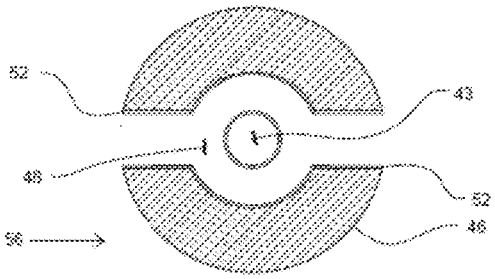
FIGS. 1*f-g* are top cross sectional views of a second port array embodiment of the coaxial material-stirring lance in FIG. 1, taken at sections B-B and C-C, the second embodiment of the ports arranged as a repeating pattern of alternating pairs of opposed port arrays.
Figure 1G:
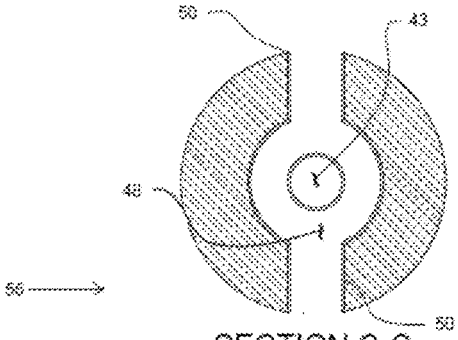

Turning now to FIGS. 1*e-g*, in a second port array embodiment or opposed port array 56, along the horizontal cross section A-A shown in FIG. 1*e*, the stirring gas connection pipe 44 is shown leading into the gas chamber 48, the gas chamber 48 again encased with the refractory coating 46. The material connection pipe 42 is positioned inside the gas chamber 48. At the horizontal cross section B-B, shown in FIG. 1*f*, the gas chamber 48 is dispersed with two upper gas ports 50, shown as a pair of opposed ports in a straight 180 degree configuration, the ports 50 forming an open channel leading out of the gas chamber 48. In FIG. 1*g* at the section C-C, the gas chamber 48 is dispersed with two lower gas ports 52 in a similar pair of opposed ports in a straight 180 degree configuration as the upper ports 50, but rotated 90 degrees relative to the upper ports at the section B-B, so as to create an alternating pattern of upper and lower ports.

For both the first port array and second port array, turning to FIG. 1*h*, at lower section D-D, the material chamber 43 terminates in a pipe having a T-configuration, with a material discharge port 60 on opposing sides of the T-configuration. At FIG. 1*d*, above the material discharge ports 60 at upper section D-D is a pair of opposed bottom ports 51 leading out of the gas chamber 48.

Figure 2:
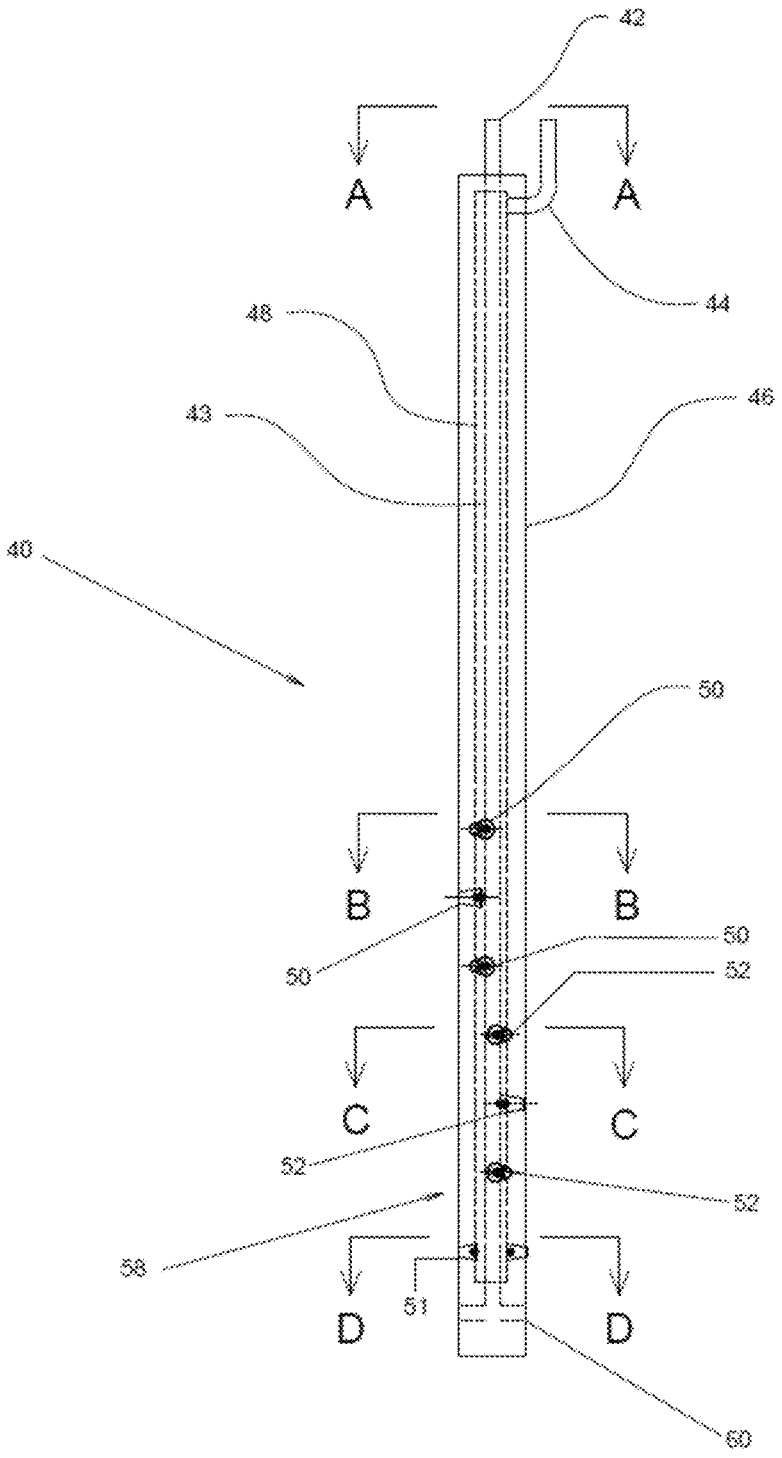
FIG. 2 is a side elevation, cross sectional view of a third port array embodiment of the coaxial material-stirring lance according to the invention, showing a spiral array of ports.
Figure 2A:
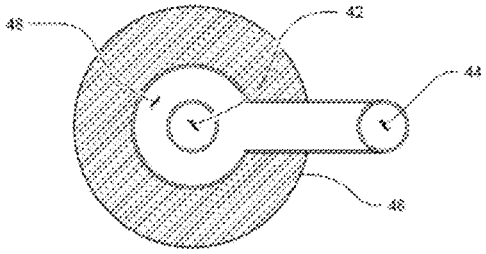
FIG. 2*a* is a top cross sectional view of the coaxial material-stirring lance in FIG. 2, taken at section A-A.
Figure 2D:
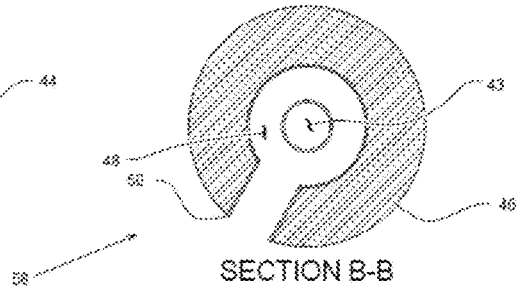
FIGS. 2*b-d* are top cross sectional views of the coaxial material-stirring lance in FIG. 2, taken at section B-B, where section B-B has three subsections of upper, middle, and lower port locations.
Figure 2B:
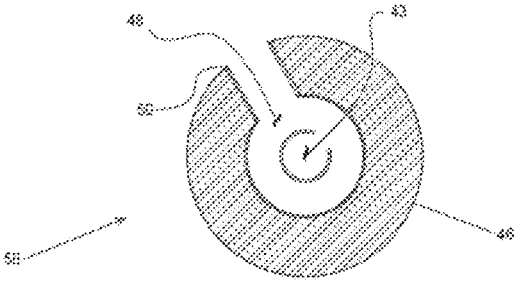
Figure 2E:
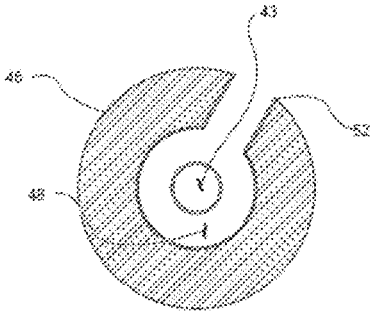
FIGS. 2*e-g* are top cross sectional views of the coaxial material-stirring lance in FIG. 2, taken at section C-C, where section C-C has three subsections of upper, middle, and lower port locations.
Figure 2C:
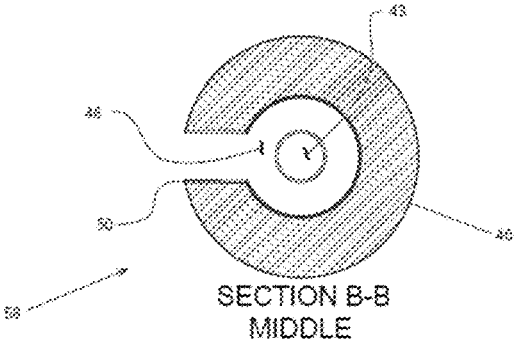
Figure 2F:
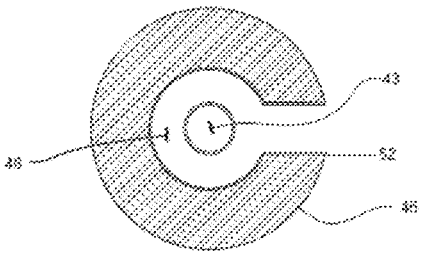

Turning now to FIG. 2 and FIGS. 2*a-i*, a third port array embodiment or spiral port array 58 is provided as a series of ports arranged in a spiral pattern about the coaxial material-stirring lance 40. Turning to FIGS. 2*b-d* (section B-B of FIG. 2), and FIGS. 2*e-g* (section C-C of FIG. 2), for section B-B there is an upper port, a middle port, and a lower port, the upper, middle, and lower ports existing along an upper plane, middle plane, and lower plane, respectively and for the section C-C each there is a second upper plane, second middle plane, and second lower plane, respectively.

Figure 2G:
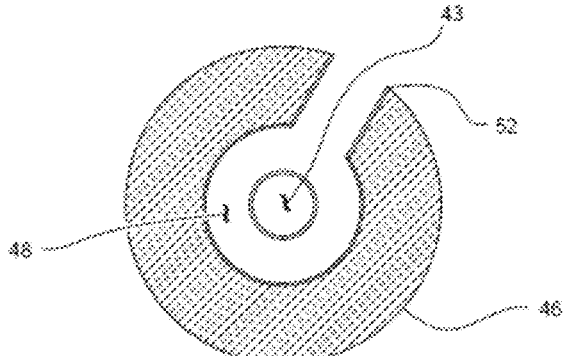

In FIG. 2*b*, the upper port is located at an approximately 11 o'clock position on the upper plane, the middle port is located at an approximately 9 o'clock position on the middle plane, and the lower port is located at an approximately 7 o'clock position on the lower plane. In FIGS. 2*e* and 2*g*, the upper port and the lower port are both located at an approximately 1 o'clock position, with the upper port located at a second upper plane, and the lower port located at a second lower plane, with the middle port (FIG. 2*f*) located at an approximately 3 o'clock position at a second middle plane.

Figure 2H:
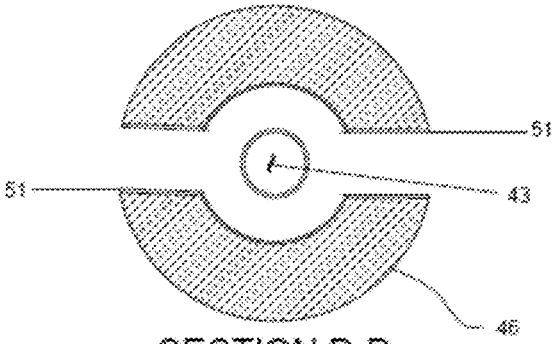
FIGS. 2*h-i* are top cross sectional views of the coaxial material-stirring lance in FIG. 2, taken at upper and lower sections D-D, respectively.
Figure 2I:
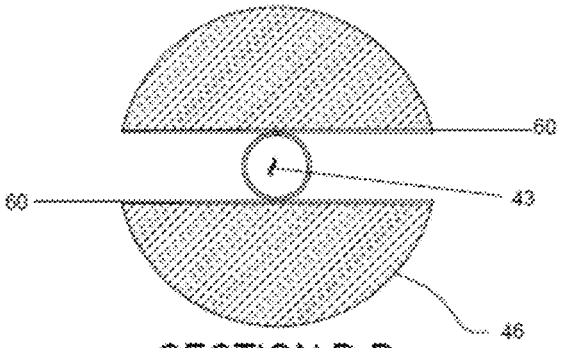

In FIG. 2*i*, the material chamber 43 terminates in a T-configuration, with a pair of opposed material discharge ports on either side of the material chamber, and in FIG. 2*h*, the gas chamber terminates in a pair of opposed bottom ports 51 below the lower ports 52 and above the material ports 60.

Figure 3:
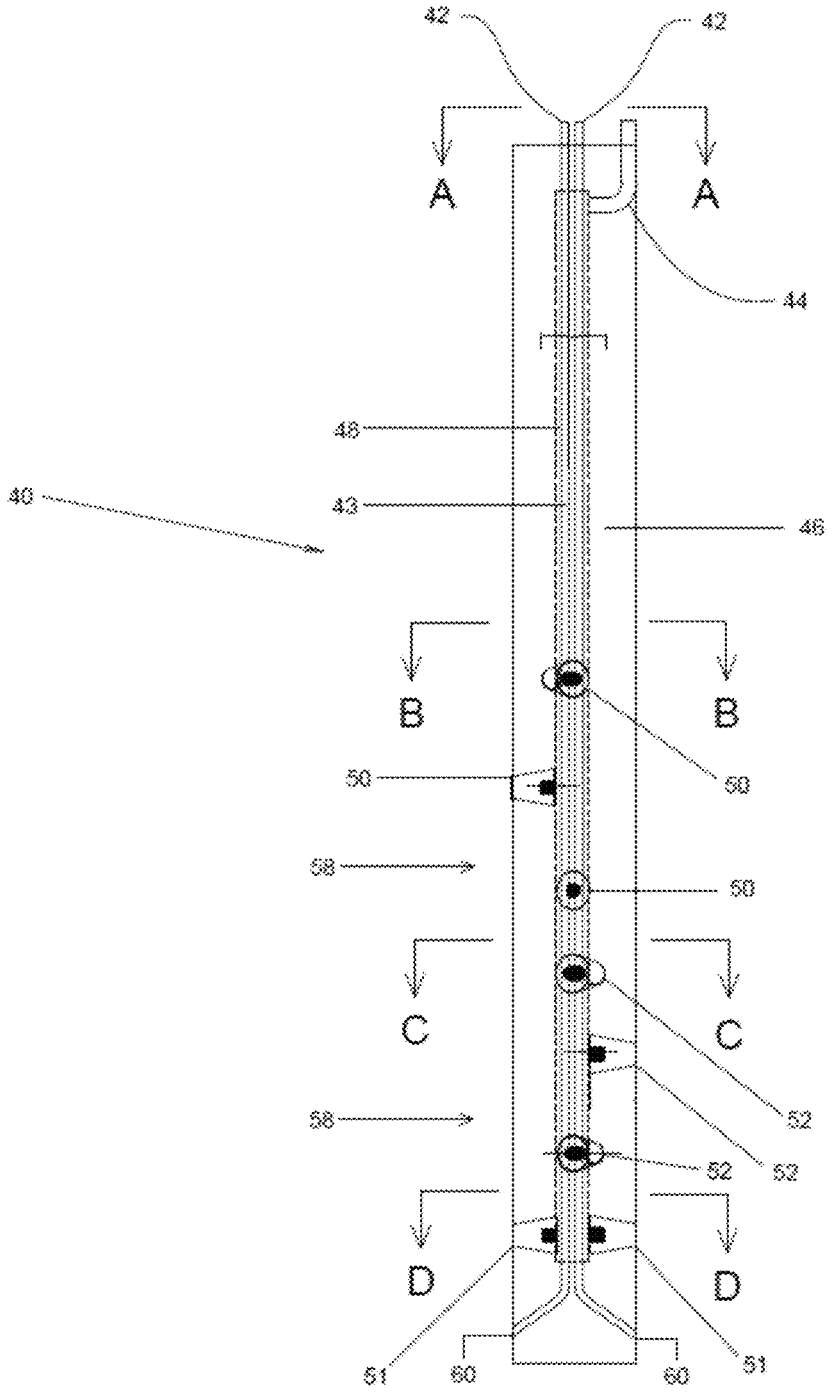
FIG. 3 is a side elevation, cross sectional view of a coaxial material-stirring lance having dual material chambers according to the invention.
Figure 3A:
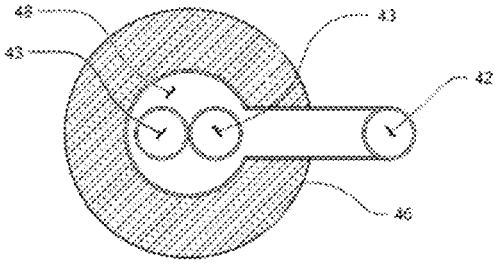
FIG. 3*a* is a top cross sectional view of the coaxial material-stirring lance in a dual material chamber embodiment of FIG. 3, taken at section A-A.
Figure 3D:
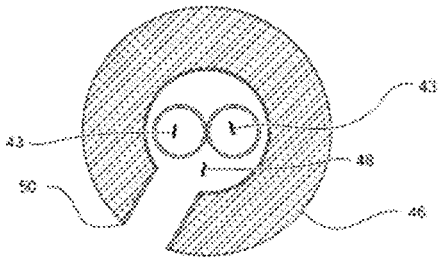
FIGS. 3*b-d* are top cross sectional views of the coaxial material-stirring lance in a dual material chamber embodiment of FIG. 3, taken at section B-B, where section B-B has three subsections of upper, middle, and lower port locations.
Figure 3B:
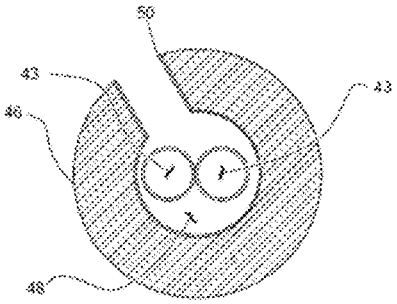
Figure 3E:
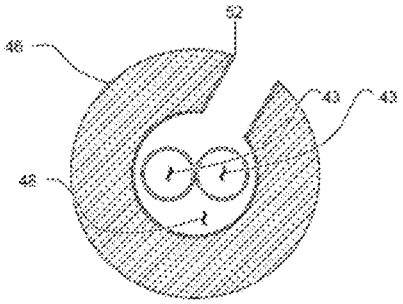
FIGS. 3*e-g* are top cross sectional views of the coaxial material-stirring lance in a dual material chamber embodiment of FIG. 3, taken at section C-C, where section C-C has three subsections of upper, middle, and lower port locations.
Figure 3C:
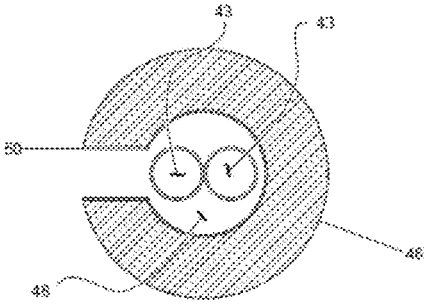

Turning to FIGS. 3 and 3*a-h*, the coaxial material-stirring lance is provided in a dual material chamber embodiment, where a pair of parallel material chambers 43 are positioned adjacent one another inside the gas chamber 48. Each material chamber 43 has its own material connection pipe 42, and its own material discharge port 60. In FIG. 3, the spiral port array 58 is shown, however, it should be noted that the cross port array 54, and the opposed port array 56 can also be used with the dual material chamber embodiment. In FIG. 3*b-d*, the upper ports 50 shown in a horizontal cross section B-B are again arranged as an upper port, a middle port, and a lower port, the upper, middle, and lower port locations existing on upper, middle, and lower planes, respectively. The upper port is located at an approximately 11 o'clock position on the upper plane, the middle port is located at an approximately 9 o'clock position on the middle plane, and the lower port is located at an approximately 7 o'clock position on the lower plane.

Figure 3F:
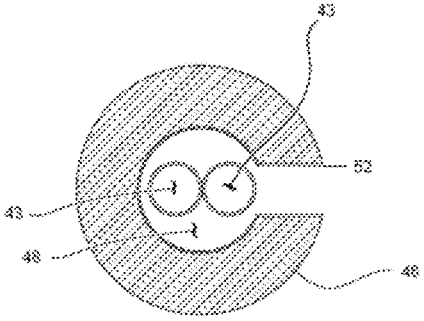
Figure 3G:
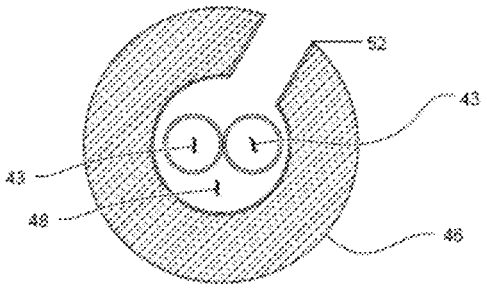
Figure 3H:
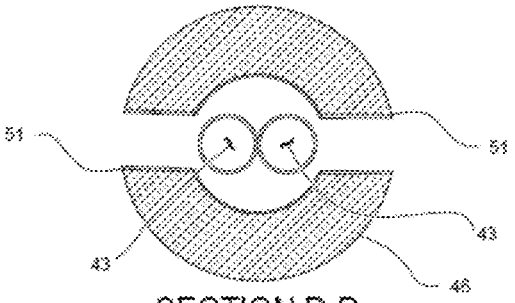
FIGS. 3*h-i* are top cross sectional views of the coaxial material-stirring lance in a dual material chamber embodiment of FIG. 3, taken at upper and lower sections D-D, respectively.

In FIGS. 3*e-g*, the lower ports 52 are arranged as an upper port at approximately 1 o'clock on the second upper plane, a middle port located at approximately 3 o'clock on the second middle plane, and a lower port located at approximately 1 o'clock at the second lower plane.

Figure 3I:
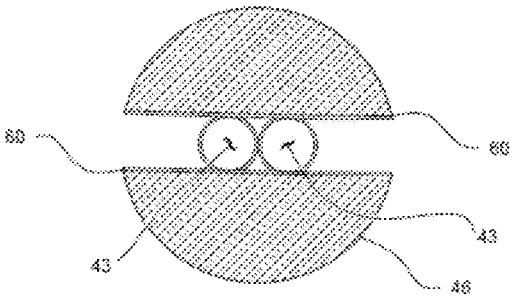

FIG. 3*i* shows the lower section D-D of FIG. 3, where two material discharge ports 60 are arranged in a "lazy L" configuration, where each material chamber is bent about 45 degrees from a vertical plane of the material chamber, terminating in a single material discharge port 60, as clearly shown in FIG. 3. At FIG. 3*h*, the pair of opposed bottom gas ports 51 are located above the material discharge ports 60 in upper section D-D. It should be noted that while the bottom ports 51 are T-configured in the drawing, a single bottom port 51 is also possible, near or at the lowermost end of the gas chamber.

Figure 4:
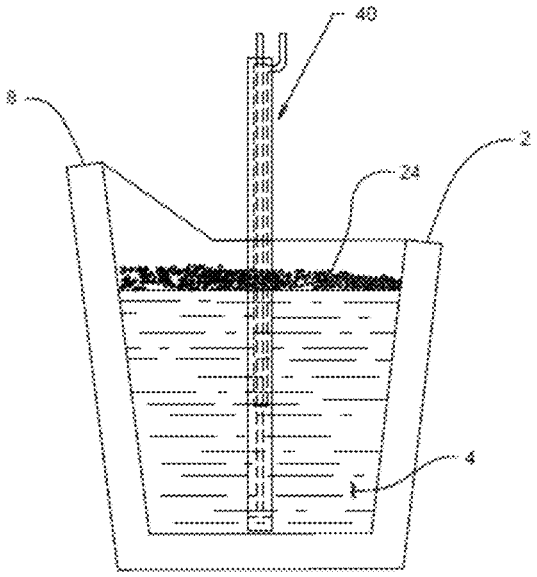
FIGS. 4 and 5 are side elevation, cross sectional views of a method of using the coaxial material-stirring lance shown before activation (FIG. 4) and during desulfurization (FIG. 5).
Figure 5:
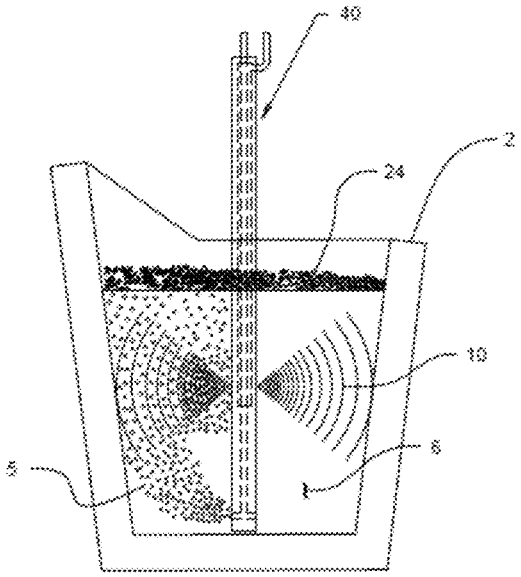

Turing now to FIGS. 4-5, a method of using the coaxial material stirring lance 40 is described. During desulfurization, the coaxial material-stirring lance 40 is positioned vertically into the ladle 2 containing the hot metal 6. A quantity of desulfurizing reagent or material 5 is deposited into the material chamber 43 via the material connection pipe 42, and exits the material chamber 43 via the material discharge ports 60 and into the hot metal 6. A volume of gas is introduced into the stirring gas connection pipe 44 and discharged into the hot metal 6 via one or a combination of the upper, lower, and bottom ports 50 52 51, at a same time as the material 5 is discharged into the hot metal, or at another time, as determined by a mill operator controlling the desulfurization process. As shown in FIG. 4, the gas is introduced below a surface 6*a* of the hot metal 6 and a plurality of bubbles 11 from the gas disperse the material 5 throughout the hot metal 6, resulting in increased reaction between reagent and sulfur, forming slag 24 that moves to the surface of the hot metal and floats along the surface 6*a*, to be later removed by skimming. The inventor notes in FIG. 5, the desulfurization process is simplified for illustrative purposes only: the material 5 in the illustration is shown as only being discharged from one port 52, and to more easily show the stirring action of the bubbles 11, gas is only emitted into the hot metal through the lower ports 52 on a right side of the illustration, and the bubbles 11 plus the material 5 are shown being uniformly dispersed in the hot metal 6 on a left side of the illustration.

When the coaxial material-stirring lance 40 is in use, the material 5 is dispersed from the material ports 60 and stirring gas bubbles 11 are emitted from any combination of upper, lower, and bottom gas ports 50 52 51 creating turbulence in the hot metal 6. The inventor notes that the ports 50 51 52 of the coaxial material-stirring lance can be configured, when desired, to have only functioning lower and bottom ports, for instance, or only functioning lower ports, or any other combination, including a single port, typically a bottom port 51, at or near the lowermost end of the gas chamber as desired. The port arrays 54 56 58 create different stirring gas patterns in the hot metal, and result in greater dispersion of the material 5 in the hot metal, and thus in greater efficiency, plus reduces the quantity of material 5 needed during desulfurization and the final result is a more consistent end product. The slag 24 on the surface 6*a* can then be removed using conventional methods, typically with a paddle or other skimming apparatus.

The inventor is recently aware of a recent coaxial lance described in U.S. Pat. No. 9,206,487 B2 (Hicks), disposed as an inner tube and an outer tube (or "gap" as termed by Hicks), into which stirring gas is introduced either into the inner tube, which then moves into the outer tube via channels formed into the inner tube, or pumped directly into the outer tube, before being expelled out the end of the lance and into the hot metal. Material and gas in some embodiments are also mixed inside the lance in a mixing chamber (Hicks' FIGS. 6A and 7D) prior to being expelled out the end of the lance.

The inventor notes that his coaxial material-stirring lance 40 as described herein is different from the lance in Hicks in many important ways: (1) material and gas are housed in separate, coaxial but independently operating chambers and material and gas never mix inside the lance 40; (2) material is expelled from the material chamber through specific material ports 60 and gas is expelled from the gas chamber through specific gas ports 50 51 52, and never does material and gas exit the lance 40 via a same port; (3) the gas chamber is always the outermost chamber, and has at least one port formed along the length of the gas chamber through the refractory coating through which gas is directly expelled into the hot metal, and in the embodiments described herein, several describe multiple gas ports and multiple port patterns and zones of ports formed into the length of the gas chamber allowing gas to be introduced into the hot metal not just near a bottom of the lance but along the entire length of the lance; and (4) the ability to control the volume of gas introduced to the hot metal and by varying port size and array, create areas inside the ladle in which lower volumes of gas are emitted but in other areas where higher gas volumes are desired, the ability to increase the volume of gas in those areas using a single lance and a single gas chamber and source of gas.

In contrast, gas in Hicks moves between communicating inner and outer tubes prior to expulsion out the bottom of the lance and into the hot metal. Under no circumstances does the gas ever leave the outer tube directly through channels formed into the outer tube through the refractory coating and directly into the hot metal as is the case with the present invention. Gas in Hicks moves between the inner and outer tubes, or between a series of interconnected tubes stacked end on end, so contents of the inner and outer tubes can mix inside the inner tube. The inventor notes that the Hicks lance shows gas only exiting the lance at or near the bottom of the lance, due to the presence of the various internal seals creating a series of stacked end-on-end, interconnected internal pressure chambers for gas and/or internal mixing chambers for gas and material. For these chambers to work as designed, they must be large enough to create the desired internal pressure and/or hold enough material and gas for mixing, and having gas and/or material exit the lance anywhere other than at or near the bottom of the lance would be impractical and render the internal interconnected chambers meaningless, as each interconnected chamber relies on the happenings inside the internal chamber above it. Further, Hicks cannot vary the volume of gas flowing out of any port into the hot metal; gas exits the lance at the same rate, and only inside the Hicks lance can the pressure of the gas stored be varied, via the series of internal chambers and seals.

In short, the inventor believes his invention is superior to the Hicks lance due to the gas port locations, the plurality of ports used along the length of the gas chamber, and the gas port arrays, particularly the spiral array, which allow greater gas and material dispersion inside the ladle. Hicks believes that mixing gas and material inside the lance prior to introduction into the hot metal increases dispersion of the material into the hot metal when a single exit port is used, but the inventor believes his gas port locations, gas port arrays, and the ability to have different volumes of gas emitted in spatially different parts of the ladle results in superior mixing of the material with the hot metal overall and thus superior efficiency in removing impurities as compared to Hicks or any of the prior art.

The inventor notes that while FIGS. 4-5 show the coaxial material-stirring lance in an embodiment with a single material chamber, however, the embodiment having a dual material chamber, shown in FIGS. 3 and 3*a-i*, is used in a same way and FIGS. 4-5 should not be interpreted as being limited to the single material chamber embodiment. The inventor has previously patented a dual lance injection apparatus U.S. Pat. No. 6,010,658, where two material lances are introduced into a same ladle, and the dual material chamber embodiment described in FIGS. 3 and 3*a-i* replaces this dual lance apparatus with a single lance, increasing cost savings to the mill operator.

The inventor notes the stirring gas can be introduced into the hot metal with or without material also being introduced, providing the mill operator flexibility of use of the coaxial material-stirring lance 40. The inventor stresses that his use of the term "port", in the singular or plural, includes any gas permeable structure such as porous plugs, nozzles, and pipes, and the Figures that show porous plugs, for instance, FIG. 3, are not meant to limit the meaning of "port" to only refer to porous plugs as shown in the Figures but is meant to illustrate one type of suitable port according to the invention. The inventor also notes that directional plugs, which have a gas permeable slit or slot are also suitable gas permeable structures for use with the invention. The term "porous plugs" also includes plate type porous material. Port size, regardless of the type of permeable structure used, varies between 0.25 to 5 inches (0.635 to 12.7 cm) in diameter and the lance can be manufactured so as to vary port sizes in a single lance, according to desires or needs of the mill operator. Varying port sizes will impact the volume of gas flowing through the ports relative each other.

The inventor notes the coaxial material-stirring lance 40 provides many benefits to the mill operator. The weight of the lance 40 for instance, is essentially the same as that of a standard prior art lance. Thus the coaxial material-stirring lance 40 can be installed onto an existing lance drive system with no structural modifications required. The only modifications to the lance drive system consist of an additional gas manifold and an additional hose to a top of the lance 40 to deliver gas to the lance 40, relatively simple and inexpensive modifications.

The inventor notes the coaxial material-stirring lance allows for significant cost reductions and efficiency/quality increases to the mill operator. Steelmaking efficiency is improved without incurring the additional capital equipment cost as required by the prior art systems, and as the coaxial material-stirring lance 40 is a combined material and gas stirring lance, only a single lance must be replaced. The mill operator may use gas only, material only, or have gas and material introduced into the hot metal simultaneously, or at different times or different frequencies, as desired, allowing the mill operator the most flexibility and functionality with a single lance. The dual material chamber embodiment represents significant cost savings for the mill operator, as a single lance (and its requisite equipment) can achieve a same or better results as the dual material lance systems previously patented, and without substantive capital investment by the mill operator.

It is to be understood the above-described arrangements are only illustrative of the application of the principles of the present invention. Numerous modifications and alternative arrangements may be devised by those skilled in the art without departing from the scope of the present invention. For instance, the invention is shown as being generally cylindrical in shape, with a circular cross section, however other shapes, such as triangular and hexagonal prisms, with triangular and hexagonal cross sections, cubes and cuboid, with square and rectangular cross sections, or other three dimensional shapes, even spherical or irregular can also be used. The coaxial combination of gas and material chambers in a single lance, the port arrays which maximize mixing of material within the hot metal, and the ability to control the volume and/or rate of flow of stirring gas via port size, type, and location are key features of the coaxial material-stirring lance. Whether the coaxial chambers have square or other shaped cross sections, or flat walls versus curved, are variations that are inconsequential to the functioning of the invention, and the circular cross sections shown in the Figures are not meant to exclude these other possible shapes for the coaxial chambers but are just an example of one possible useful shape.

What is claimed is:

1. A coaxial material-stirring lance (40) for use in a hot metal desulfurization process performed in a mill having a motorized lance drive with a lance weight support capacity, a ladle holding a predetermined quantity of hot metal, and a gas manifold supplying a gas supply, where the coaxial material-stirring lance is supported by the motorized lance drive in the predetermined quantity of hot metal in the ladle, the coaxial material-stirring lance comprising:

a gas chamber (48) having a first end and a terminal end, and a length between the first end and the terminal end defining a chamber wall, the chamber wall further defining an interior space having an interior wall side facing the interior space and an opposed outer wall side;

a refractory coat (46) encasing an exterior of the coaxial material-stirring lance;

a gas connection pipe (44) at the first end coupled to the gas manifold and to the gas supply;

at least one material chamber (43) defined by a material chamber wall having at a first end a material connection pipe (42) and at a second end terminating in at least one material discharge port (60);

a port disposed as a gas permeable structure having a body formed with an inlet at one end and an opposed outlet, the inlet positioned against the opposed outer wall side and secured to a through-hole formed into the chamber wall, and the outlet positioned relative to the refractory coat so as to allow fluid communication between the interior space of the gas chamber and an exterior area beyond the refractory coat through the port; and a weight of the coaxial material-stirring lance (40);

wherein the weight of the coaxial material-stirring lance is a same weight as the lance weight capable of support by the motorized lance drive;

wherein the refractory coat encases both the outer wall side and an exterior of the body of the port;

wherein the outlet has an outlet diameter measurement between about 0.5 cm to about 13 cm;

wherein the port is further comprised of a bottom port (51) and at least one of an upper port (50) and a lower port (52) in vertical spaced-apart relationship with the bottom port;

wherein the bottom port and the at least one of the upper port and the lower port is at least one of a pipe, a porous plug, a directional plug, and a nozzle; and wherein the material chamber (43) is positioned inside the gas chamber (48) so as to create a pair of coaxial chambers.

2. The coaxial material-stirring lance (40) in claim 1, wherein the material chamber (43) terminates in a pipe having a pair of opposed material discharge ports (60), forming a T-configuration.

3. The coaxial material-stirring lance (40) in claim 1, wherein the upper port (50) is an upper array having a plurality of ports arranged in a cross-shaped orientation (54) having two pairs of opposed ports leading from the gas chamber (48).

4. The coaxial material-stirring lance (40) in claim 3, wherein the lower port (52) is a lower array having a plurality of ports arranged in an cross-shaped orientation (54) having two pairs of opposed ports leading from the gas chamber (48) and in relation to the upper array, the lower array is turned approximately 45 degrees such that the upper array has a cross-shaped orientation and the lower array has an X-shaped orientation, the upper array and the lower array arranged in alternating cross and X-shaped orientations.

5. The coaxial material-stirring lance (40) in claim 1, wherein the upper port is an upper array comprised of a pair of opposed ports (56).

6. The coaxial material-stirring lance (40) in claim 5, wherein the lower port is a lower array comprised of a pair of opposed ports (56) oriented in relation to the upper array such that the lower array is turned 90 degrees relative to the upper array and wherein the upper array and lower array are arranged in an alternating pattern.

7. The coaxial material-stirring lance (40) of claim 1, wherein the at least one of the upper port (50) and the lower port (52) is a spiral array (58) of ports about the chamber wall having at least two ports in vertical spaced-apart relationship about the chamber wall separated by no more than 45 degrees about the chamber wall such that the at least two ports are vertically unaligned.

8. The coaxial material-stirring lance (40) of claim 7, wherein at least one of the upper port, middle port, and lower port of the spiral array (58) of the upper port (50) has a smaller outlet diameter measurement relative to another outlet diameter measurement of at least one of the upper port, middle port, and lower port of the spiral array (58) of the lower port (52).

9. The coaxial material-stirring lance (40) of claim 1, further comprising a second material chamber (43) adjacent to and parallel to the material chamber (43);

wherein the second material chamber (43) has a material connection pipe (42) at a first end and terminates in at least one material discharge port (60) at a second end; and wherein the second material chamber (43) is positioned inside the gas chamber (48).

10. A method of using the coaxial material-stirring lance (40) of claim 1, during a hot metal desulfurization purification process using an existing motorized lance drive with a maximum lance weight support capacity to support the coaxial material-stirring lance, a quantity of hot metal in a ladle having a predetermined volume and size, a gas manifold with a gas supply, and a desulfurizing material, the method comprising the steps of:

Positioning the coaxial material-stirring lance vertically into the ladle of hot metal;

Introducing a quantity of desulfurizing material into the material chamber;

Introducing a volume of stirring gas into the gas chamber;

Discharging the quantity of desulfurizing material from the material chamber through a material port and into the hot metal; and Discharging the volume of stirring gas through at least the bottom port into the hot metal.

11. The method of claim 10, wherein the steps of discharging the quantity of material and discharging the volume of stirring gas is performed simultaneously.

12. The coaxial material-stirring lance of claim 1, wherein the bottom port (51) has a first outlet diameter measurement and the at least one of the upper port (50) and the lower port (52) has a second outlet diameter measurement.

13. A method of using the coaxial material-stirring lance (40) of claim 9, during a hot metal desulfurization purification process using an existing motorized lance drive with a maximum lance weight support capacity to support the coaxial material-stirring lance, a quantity of hot metal in a ladle having a predetermined volume and size, a gas manifold with a gas supply, and a desulfurizing material, the method comprising the steps of:

Positioning the coaxial material-stirring lance vertically into the ladle of hot metal;

Introducing a quantity of desulfurizing material into the material chamber;

Introducing a volume of stirring gas into the gas chamber;

Discharging the quantity of desulfurizing material from the material chamber through a material port and into the hot metal; and Discharging the volume of stirring gas through at least the bottom port into the hot metal.

* * * * *